US006021611A

United States Patent [19]

Wells et al.

[11] Patent Number: 6,021,611

[45] **Date of Patent: *Feb. 8, 2000**

[54] SHINGLE HAVING RIBS AND A CAVITY ON ITS UNDERSIDE

[76] Inventors: James R. Wells, 1854 Walnut Rd., Heath, Ohio 43056; James C. Wintgens, 2552 Dutch La., Newark, Ohio 43055; Roger A. McFarland, 2787 Dayton Rd., NE, Newark, Ohio 40355

[ * ] Notice: This patent is subject to a terminal disclaimer.

[21] Appl. No.: 08/886,662

[22] Filed: Jul. 2, 1997

Related U.S. Application Data

[63] Continuation of application No. 08/427,529, Apr. 24, 1995, abandoned.

[51] Int. Cl.[7] ..... F02D 1/20; F02D 1/24

[52] U.S. Cl. ..... 52/98; 52/309.1; 52/520; 52/555; 52/559; 52/560; 52/314

[58] Field of Search ..... 52/98, 302.4, 518–520, 52/553–555, 557–560, 309.1, 309.2, 309.13, 314, 596, 602, 612, 533, 543; 106/724, 794, 802, DIG. 1; 524/492–494, 449, 445, 447

[56] References Cited

U.S. PATENT DOCUMENTS

| | | | |
|---|---|---|---|
| 1,404,483 | 1/1922 | Scharwath et al. | 52/560 |
| 1,929,165 | 10/1933 | Freegard . | |
| 2,168,218 | 8/1939 | Kirschbraun | 52/602 X |
| 3,030,234 | 4/1962 | McClinton . | |
| 3,344,011 | 9/1967 | Goozner | 52/309.13 X |
| 3,507,079 | 4/1970 | George . | |
| 3,579,940 | 5/1971 | Greenleaf | 52/553 X |
| 3,608,261 | 9/1971 | French et al. . | |
| 3,830,687 | 8/1974 | Re et al. . | |
| 3,847,865 | 11/1974 | Duggins . | |
| 3,899,855 | 8/1975 | Gadsby . | |

(List continued on next page.)

FOREIGN PATENT DOCUMENTS

| | | |
|---|---|---|
| 62929/86 | 3/1987 | Australia . |
| 0010468 | 4/1980 | European Pat. Off. . |
| 0020102 | 12/1980 | European Pat. Off. . |
| 0209649 | 1/1987 | European Pat. Off. . |
| 2469513 | 5/1981 | France . |
| 2526015 | 4/1982 | France . |
| 3713320 | 11/1988 | Germany . |
| 2041959 | 9/1980 | United Kingdom . |
| 2129002 | 5/1984 | United Kingdom . |
| WO9409223 | 4/1994 | WIPO . |

OTHER PUBLICATIONS

Derwent AN 82–07622J, Abstract of JP 57–178732 (Nov. 1982).

Patent Abstracts of Japan, vol. 11, No. 267 (C–443), Aug. 28, 1987, abstract of JP 62–068848.

Canadian Patent Office Record, No. 386,873, Mastic Shingle Manufacture.

*Primary Examiner*—Robert Canfield

*Attorney, Agent, or Firm*—Inger H. Eckert; James J. Dottavio

[57] ABSTRACT

A roofing shingle includes organic, resinous material and an inorganic filler material, the single having a top surface, two side surfaces, an upper end, and a lower or butt end, defining a cavity on the underside of the shingle, with ribs positioned within the cavity. When applied to a roof, the shingle has the appearance of wooden shake shingle and provides a Class A fire barrier when tested according to ASTM test E108-93 for flame spread, burning brand and intermittent flame.

39 Claims, 4 Drawing Sheets

SHINGLE HAVING RIBS AND A CAVITY ON ITS UNDERSIDE

CROSS-REFERENCE TO RELATED APPLICATIONS

This is a continuation of U.S. patent application Ser. No. 08/427,529, filed Apr. 24, 1995 now abandoned.

TECHNICAL FIELD

This invention relates to shingles of the type suitable for providing an aesthetically pleasing appearance and a high degree of weatherability when applied to a building. More particularly, this invention relates to shingles comprised of organic, resinous material and an inorganic filler material.

BACKGROUND

Conventional roof coverings for sloped roofs include asphalt shingles, wooden shake shingles, sheet metal, slate, clay and concrete tile. Sheet metal, clay and slate are advantageous because of their high weatherability. Various parts of the world have local or regional architectural preferences for the appearance of the roof. In Europe, clay tile is generally preferred over the relatively flat looking asphalt shingle. Tastes in the U.S. vary, with the western and southwestern part of the U.S. preferring clay tile or wooden shake shingles.

One of the problems with clay tile and slate roofs is that the clay and slate tiles require significant labor to apply. The asphalt or wood shingles are nailable and are simply nailed to a roof deck in courses, usually from the bottom or eave to the top or ridge of the roof. Clay, concrete and slate tiles are heavier than asphalt shingles, and require more support to hold up the roof. The installed cost of clay and slate tiles exceeds that of asphalt shingles. Clay and slate tiles are inherently fragile, and suffer much breakage during shipping and installation. These materials are fragile even after installation on the root and can be damaged by foot traffic on the roof.

Wooden shake shingles are generally flat boards, usually of cedar or other coniferous trees. The wooden shakes are nailed in courses on the roof deck, with the exposed or tab portions of the shingles of a subsequent course being laid over the headlap portions of the previous course of shingles. The shingles are cut so that the wood grain runs up the slope of the roof for an aesthetically pleasing appearance. The cutting of the wood, and the subsequent weathering of the shingles after installation on the roof create grooves and ridges running in the direction of the wood grain. A disadvantage of wooden shake shingles is that they absorb moisture and swell. Therefore, they must be applied in a spaced-apart arrangement to allow room for expansion. Because of the propensity of wooden shake shingles to absorb water, they tend to curl and not remain flat on the roof.

One of the desirable attributes of any roofing material is to be able to resist fires. This is particularly true in regions having a hot and dry climate, although fire resistance is desirable everywhere. A particularly important aspect of fire resistance is the ability of the roofing material to prevent a fire, or a source of heat such as a burning ember, from burning through the roofing material to thereby expose the roof deck or interior of the building to the fire. Metal roofs and clay and tile roofs have inherent advantages in fire resistance over wood shake shingle roofs. Asphalt shingles contain greater than 60 percent filler of finely ground inorganic particulate matter, such as limestone, and therefore are sufficiently fire resistant to obtain a Class A fire rating when measured by appropriate tests. Wooden shake shingles, even when treated with a fire retardant material, are not generally fire resistant and cannot achieve a Class A fire rating. Shake shingles are particularly prone to failing the fire tests (absent fireproofing underlayments) because the shingles cannot be placed with side edges abutting, and the gaps between adjacent shingles contribute to the failure of the shake shingles to pass the fire tests.

Attempts have been made in the past to make cement, synthetic or plastic shingles or tiles to replicate the aesthetically pleasing look of wooden shake roof or tile roofs. Various experiments have been tried to make reinforced cement shingles or tiles. Weatherability and long term stability of color can be a problem. Likewise, synthetic or plastic shingles or tiles have not been successful in replacing traditional roofing materials. The plastic material is generally too expensive in material costs, and traditional plastics do not weather well when exposed to sunlight in a roof application for extended periods of time. Further, the plastic material lacks fire resistant qualities.

It would be desirable to have a shingle made of a plastic material which would overcome the disadvantages of previous attempts to produce synthetic or plastic shingles. The ideal shingle would have an aesthetically pleasing appearance, such as the appearance of a wooden shake shingle, and yet would be superior to the wooden shake shingle in both weatherability and fire resistance. The shingle would be light weight, low in manufacturing cost, and would have a generally permanent color.

DISCLOSURE OF INVENTION

There has now been developed a shingle which meets all of the above criteria. The shingle comprises an organic, resinous material and a filler material. The shingle is preferably molded, and most preferably compression molded, and is nailable onto a roof deck to form an aesthetically pleasing roof covering having high weatherability. Also, preferably, the shingle has the appearance of a shake shingle. The organic, resinous material in the shingle is in an amount within the range of from about 12 to about 35 percent by weight, and a filler material is in an amount within the range of from about 65 to about 88 percent by weight. The high amount of inorganic filler material contributes to a Class A fire resistance rating. In a preferred shingle the resin comprises polyester resin derived from input stock containing polyethylene terephthalate (PET). The filler material preferably comprises one or more of the group consisting of clay particles, slate particles, shale particles and glass fibers.

In one embodiment of the invention, the resin contains no pigment other than the color of the filler material.

In another embodiment of the invention, when a plurality of the shingles of the invention are applied to a roof, the roof will have a Class A fire barrier when tested according to ASTM test E108-93 for flame spread, burning brand and intermittent flame.

According to this invention, there is also provided a roofing shingle comprising organic, resinous material and an inorganic filler material, the shingle having a top surface, two side surfaces, an upper end, and a lower or butt end, defining a cavity on the underside of the shingle, with ribs positioned within the cavity.

In one embodiment of the invention, the shingle top surface has a tab portion which is normally exposed on the roof and a headlap portion which is normally covered up on the roof, the lower part of the tab portion being thicker than the remainder of the tab portion, and the upper part of the headlap portion being thinner than the remainder of the headlap portion to facilitate efficient packing of two adjacent shingles during packaging, with the top portions of the two shingles in contact with each other, and the lower part of the tab portion being aligned with the upper part of the headlap portion.

In another embodiment of the invention, the two side surfaces, the upper end and the butt end extend downwardly, with the bottom or downwardly extending edges of the two side surfaces, the upper end and the butt end generally lying in a common plane, and ribs also extend generally downwardly from the top surface to the same plane, so that the ribs support the top surface of the shingle, thereby preventing sag of the shingle when the shingle is heated.

In yet another embodiment of the invention, the shingle has a nailing strip in the lower end of the headlap portion, with the ribs in the lower end of the tab portion being recessed so that they do not extend fully to the common plane in the area which normally overlies the nailing strip of the previous course of shingles on a roof, so that the ribs do not come in contact with nails in the nailing strips of the previously laid course of shingles.

In a preferred embodiment of the invention the tab portion of the shingle is narrower than the headlap portion so that the distance between the shingle side surfaces in the tab portion is shorter than the distance between the side surfaces in the headlap portion.

In yet another embodiment of the invention, the roofing shingle has a nailing strip comprising a plurality of ridges molded into the top surface of the shingle, and the shingle has ribs on the underside of the top surface which are aligned with the ridges in the nailing strip, with a ridge positioned above each rib, so that nails striking the nailing strip will be directed to the spaces between the ridges and thereby the nails will be directed away from the ribs.

According to this invention, there is also provided a bundle of the roofing shingles of the invention. The invention also includes a roof comprising a roof deck and a plurality of roofing shingles of the invention.

BEST MODE FOR CARRYING OUT THE INVENTION

Figures 1, 2:
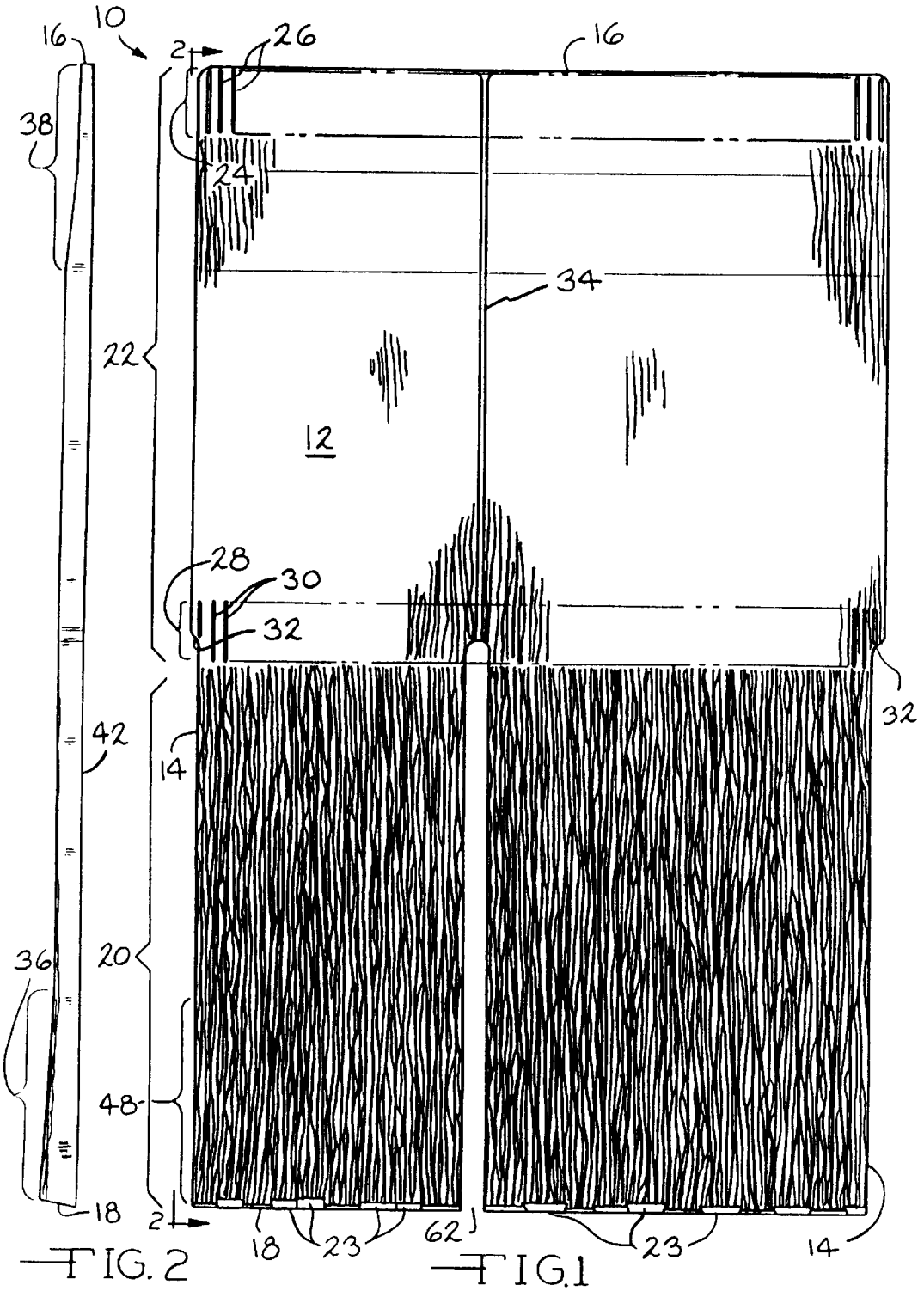
FIG. 1 is a schematic plan view of the top of a shingle of the invention.
FIG. 2 is a view in elevation taken along line 2—2 of FIG. 1.

The invention will be described with reference to roofing shingles which are similar in appearance to wood shake shingles. It is to be understood, however, that the terms "shingles" and "roofing shingles" also include shingles, tiles and panels, and the shingles, tiles and panels can have appearances other than wood shake shingles, such as, for example, slate panels or tiles and mission tiles.

As shown in FIGS. 1–4, the shingle 10 has a top surface 12, two side surfaces 14, upper end 16 and lower or butt end 18. The top surface of the shingle can be divided into a tab portion 20 and a headlap portion 22. In normal application of the shingles onto a roof, the headlap portion 22 of a shingle is covered by the exposed or tab portion 20 of the next course of shingles. As shown, the tab portion of the shingle has a multiplicity of grooves running in a direction which is intended to be up the slope of the roof when the shingle is installed on the roof to give the appearance of a wooden shake shingle. The butt end of the shingle preferably has a plurality of oblique surfaces 23 at differing angles to the butt end to provide the viewer with something other than a simple, straight butt end of the shingle. This will greatly enhance the aesthetic appearance of the shingle.

The top surface of the shingle contains optional nailing strips to indicate to the roofer the best location for the nails or staples to be applied to the shingle. The nailing strip 24 at the upper end of the headlap portion 22 of the shingle preferably contains ridges 26 which serve as a nailing indicator for the roofer, and which make a stronger structure for nailing purposes. The ridges can be molded into the surface of the shingle. Likewise, nailing strip 28 at the lower end of the headlap portion preferably contains ridges 30 for the same purpose. The ridges are preferably oriented parallel to the side surfaces of the shingle. The ridges can be made to look similar to the wood shake markings or grooves in the tab portion of the shingle, so that any surface showing through a gap or cutout will be similar in appearance to the wood shake look of the tab portion of the shingle.

In the preferred design the side surfaces 14 have curved portions 32 so that the width of tab portion 20 (in the direction from left to right as shown in FIG. 1) is less than the width of the headlap portion 22. This design enables the shingles of the invention to be applied so that the side surfaces of the headlap portions of adjacent shingles on a roof can be physically abutting, and yet the tab portions of the shingles need not be abutting. By avoiding a requirement that the tab portions of the shingles need to be abutting, a more pleasing appearance can be made on the roof. By designing the shingle to allow the headlap areas to be abutting, the roof system will have a greater chance of meeting the fire standards of a Class A shingle because there will be no gap providing a thermal short circuit to expose the roof deck to the heat of the burning brand. This is a distinct improvement over wooden shake shingles.

As shown in FIG. 1, the shingle can be molded as a double molded shingle, with a groove, such as break line 34, which enables the shingle to be broken or split into two smaller shingles. Preferably the break line is sufficiently thin so as to enable the shingle to be separated into two shingles by hand. By molding two smaller shingles into a single shingle with a break line, the molding and shipping processes are made more efficient while giving the roofer the flexibility to lay down more combinations of shingles where desired.

Figure 6:
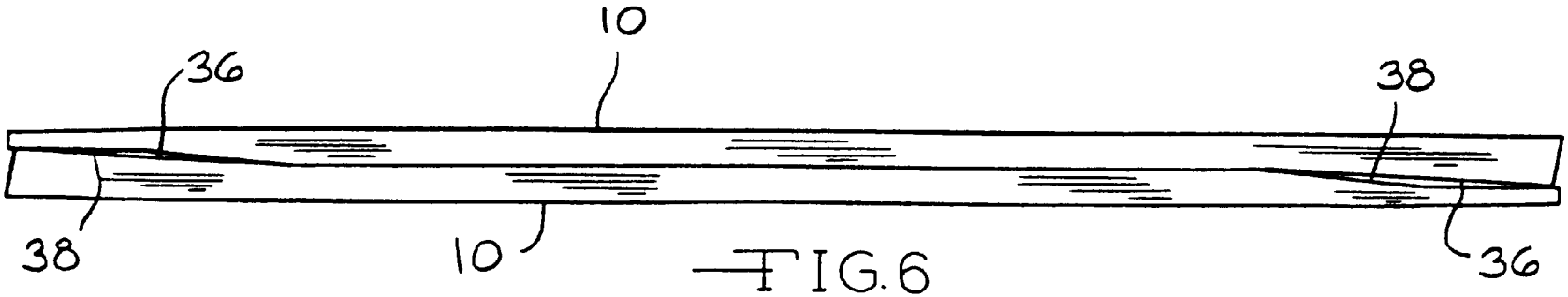
FIG. 6 is a schematic view in elevation of a pair of mated shingles of the invention.

As shown in FIG. 2, the lower part 36 of the tab portion 20 is raised or thicker than the remainder of the tab portion. This improves the aesthetic appearance on the roof by making the butt end 18 of the shingles thicker, thereby making the entire shingle appear thicker to a person viewing the roof from the ground. The shingle has a corresponding thinner or tapered portion at the other end of the shingle, which is at the upper part 38 of the headlap portion 22. As shown in FIG. 6, two shingles can be packed or nested for packaging and storage in an efficient manner, with the thickened lower parts 36 of the tab portions in contact with or nesting into the thinner upper parts 38 of the headlap portion.

Figures 3, 4:
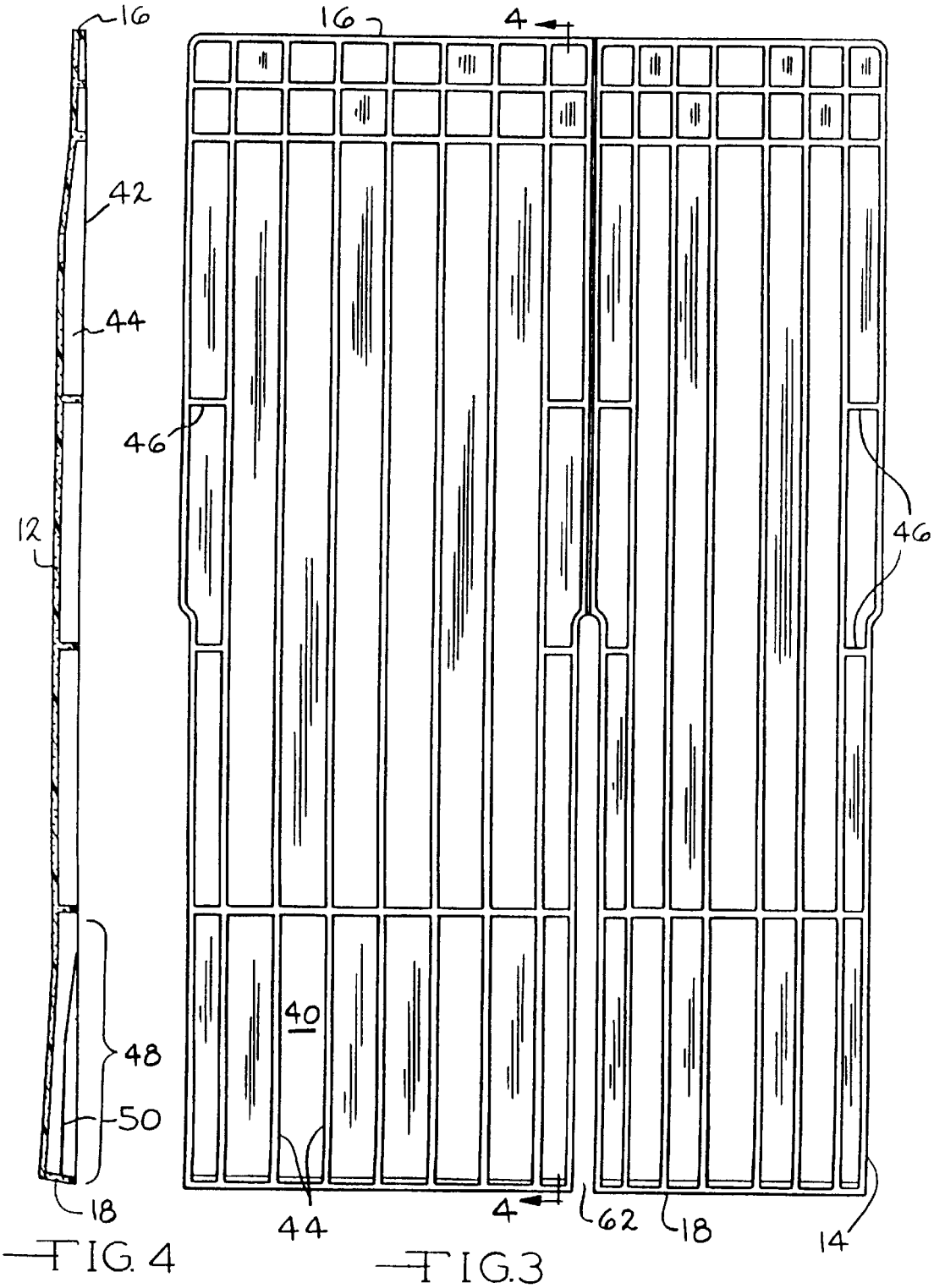
FIG. 3 is a schematic plan view of the underside of the shingle shown in FIG. 1.
FIG. 4 is a cross-sectional view in elevation taken along line 4—4 of FIG. 3.

As shown in FIGS. 3 and 4 the top surface 12, two side surfaces 14, upper end 16 and butt end 18 define an open space or cavity 40 on the underside of the shingle. Preferably the side surfaces, the upper end and the butt end all extend downwardly from the top surface to the extent that the bottom edges of the side surfaces and upper and butt ends all lie in a common plane 42.

A plurality of ribs 44 are molded into the cavity to strengthen the shingle. The ribs can be of any design, but are conveniently arranged generally parallel to the side surfaces 14 of the shingle. One of the purposes of the ribs is to provide integrity to the shingle so that when fastened to the roof with nails, the shingle will not split or tear away from the nails. Another purpose of the ribs is to provide sufficient flexural strength and rigidity required for the product with efficient use of material. Since the shingles of the invention are nailable, the nails can be driven anywhere through the shingle, but are preferably driven through the nailing strips. Nail holes are not required. The ribs are preferably molded integrally with the top surface 12. If the ribs are made to extend downwardly into the cavity to the extent that the bottom edge of the ribs lies in the common plane 42, then the ribs can support the top surface of the shingle. This will enable the shingle to be supported to prevent sagging when the shingle is in a heated condition, such as during the cooldown phase following the molding process, or during storage of the shingles, or after application to a roof.

Although it is generally desirable for the ribs to extend all the way down from the underside of the top surface to the common plane, there is one area where the ribs should be shallower. When a shingle is laid on a roof, nails are driven through the lower nailing strip 28. In the next course of shingles, the overlying shingle will have the lower end part 48 of the tab portion 20 directly over nailing strip 28. If any nails are not completely driven home, the rib of the overlying shingle could potentially rest on a nail protruding above the top surface of the shingle. For this reason, the ribs beneath the lower end 48 of the tab portion are provided with recess 50, as shown in FIG. 4. The recess keeps the ribs from coming into contact with nails in the nailing strips of the previously laid course of shingles.

Preferably, the shingle is adapted with several side ribs 46 which are generally perpendicular to the side surfaces 14. These side ribs prevent a shingle from nesting within an adjacent shingle while the shingles are packaged in a bundle. "Nesting" is where one of the side surfaces slides or slips into the cavity of an adjacent shingle in a bundle. The nesting of the shingles after they are packaged in a bundle is undesirable because nesting makes the bundle smaller, thereby having the effect of loosening the bundle.

When nails are driven through the nailing strips 24 and 28, there is a strong tendency that the nails will slide off the ridges 26 and 30 in the nailing strips and penetrate the top surface in a valley immediately adjacent the ridges. For this reason it is preferable to position the ridges so that a ridge is positioned directly above each rib. This will help ensure that nails striking the nailing strips will be directed toward the valleys between the ridges and away from the ribs.

Figure 5:
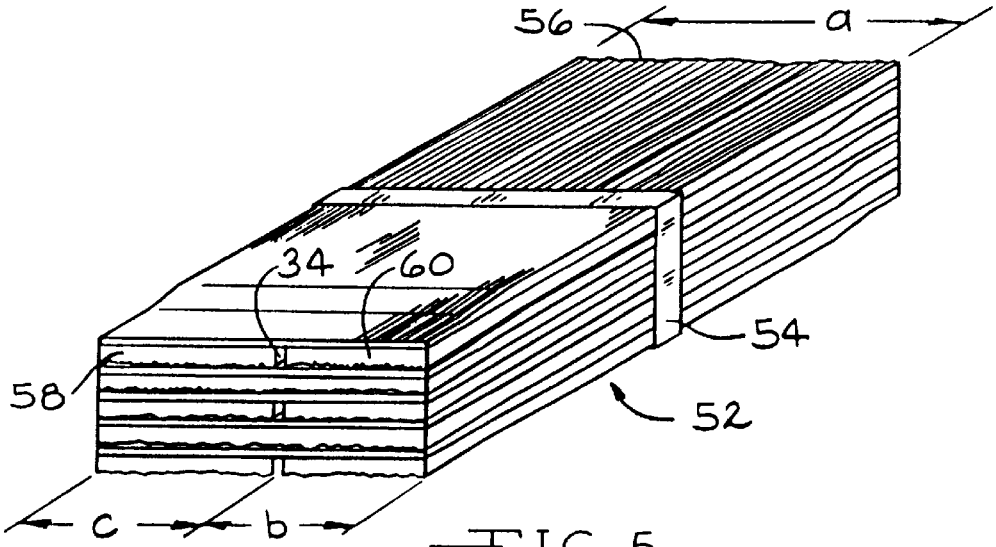
FIG. 5 is a schematic view in perspective of a bundle of shingles of the invention.
Figure 8:
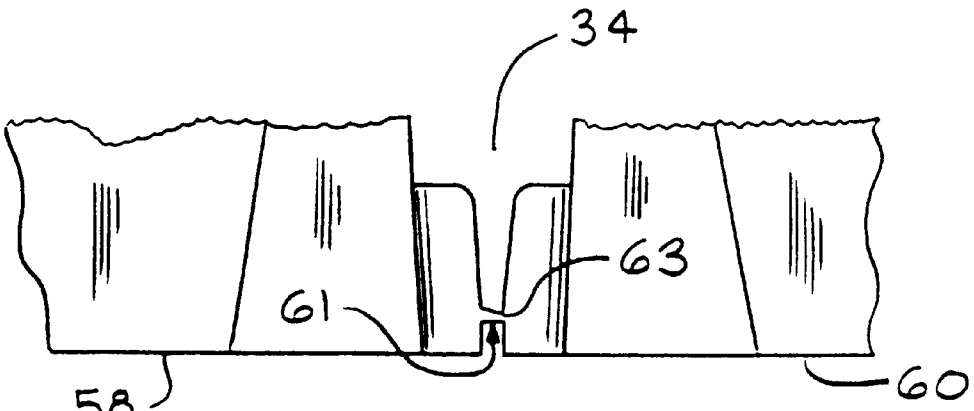
FIG. 8 is a schematic view in elevation illustrating detail of the joint where two shingles are molded together.

As shown in FIG. 5, the shingle can be packaged in a bundle 52 and secured by any means, such as strap 54. In a preferred embodiment, the bundle contains two different shingle types. First is a wide shingle, such as shingle 56. The second is a double molded shingle, having a breakline such as breakline 34, so that the shingle can be broken by hand into an intermediate shingle 58 and a narrow shingle 60. The cutout between the intermediate and narrow shingles is indicated at 62. The breakline 34 is shown in more detail in FIG. 8. The two shingles 58 and 60 are joined by a thin attachment strip 61 formed during the molding process, which is defined by the breakline 34. The attachment strip 61 is of sufficient strength to enable the double molded shingle to be applied on the roof as two connected shingles, and yet thin enough that a roofer can separate the parts of the double molded shingle into two distinct shingles. Preferably, the attachment strip 61 is narrower on one side, such as the right hand side 63 shown in FIG. 8, so that the splitting of the double molded shingle into two distinct shingles by hand will always result in a predictable, even break line which is aesthetically pleasing on the roof.

For packaging purposes it is advantageous for the intermediate and narrow shingles to have a combined width approximately equal to the width of the wide shingle. Using the width designations shown in FIG. 5, it can be seen that a=b+c, where "a" is the width of the wide shingle 56, and "b" and "c" are the widths of the narrow and intermediate shingles 60 and 58, respectively. The terminology "a equals b+c" is intended to include arrangements in which the width of "a" is within 5 percent of the width of b+c. Preferred widths for the three shingles are about 13 inches for "a", about 5½ inches for "b" and about 7½ inches for "c".

Figure 7:
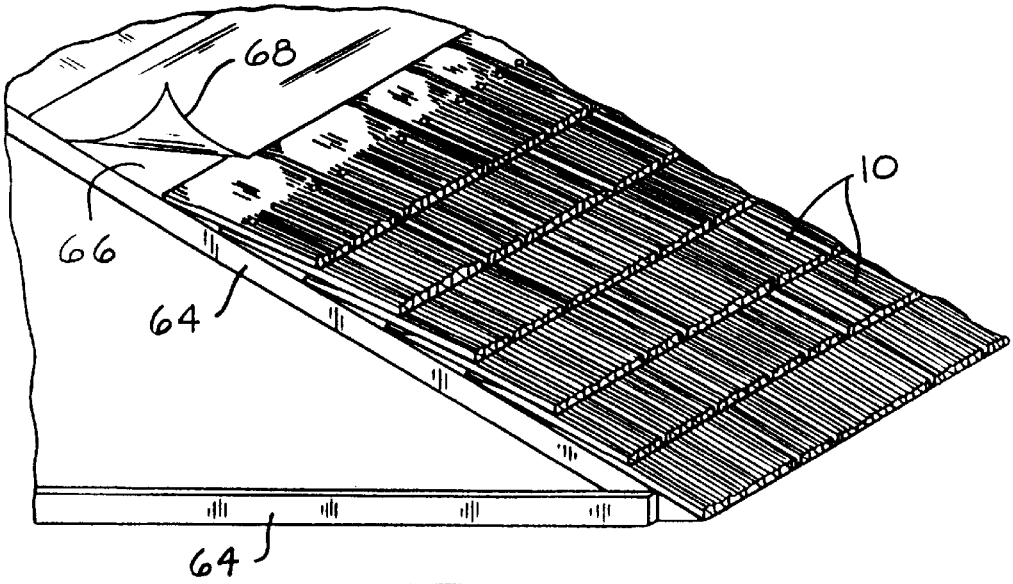
FIG. 7 is a schematic view in perspective of a roof containing shingles of the invention.

As shown in FIG. 7, the shingles are shown as being applied as a roof covering on a roof. The roof comprises an appropriate support structure such as joists or rafters 64, and a roof deck 66, which can be continuous or intermittently spaced boards. The shingles are laid in courses from the bottom up, and provide an aesthetically pleasing appearance. A water resistant roofing felt 68 is preferably applied above each course of shingles to overlay the upper nailing strip 24.

The composition of the shingle includes organic, resinous material in an amount within the range of from about 12 to about 35 percent by weight, and a filler material in an amount within the range of from about 65 to about 88 percent by weight. Preferably, the resinous material is present in an amount within the range of from about 15 to about 24 percent by weight, and a filler material is present in an amount within the range of from about 76 to about 85 percent by weight. In its most preferred form, the shingle comprises about 20 percent resinous material by weight and about 80 percent filler material by weight.

For purposes of this specification and claims, the terms "resin" and "resinous material" mean any organic substance which can act as a matrix for the inorganic filler material. The resin or resinous material can be either a thermoplastic or thermoset, but is preferably a thermoset material. Examples of materials which are resinous and suitable for use with the invention are polyester, polyethyleneterephthalate (PET), polycarbonate and polypropylene resins. In general, the resins preferred are plastic resins, containing no asphalts, or only small amounts of asphalt, such as less than about 5 percent. Thermoset polyester resins are the most preferred, although a small amount of PET can be added to the input stock in the resin process so that the polyester resin is derived from input stock containing PET. This provides more flexibility to the shingle. Examples of resins suitable for use with the invention include resins E-606, E-650, E-120 and 55M-70 from Alpha/Owens-Coming, L.L.C., Memphis, Tenn. The resinous material can include small amounts of other materials such as mold release agents.

Numerous filler materials can be used with the invention. Examples include clay, aluminum trihydrate, glass fibers of various lengths, other fibrous reinforcements (organic or inorganic), and finely divided slate, shale, limestone, fly ash, bottom ash and talc. The filler material is finely ground. The particles must be small enough to blend into the resin matrix, especially when molded into narrow parts, such as the ridges and the ribs. The filler particles cannot be too small or else the surface area will be so great as to excessively bind up all the resin, thereby requiring increased amounts of the resin, which is a much more expensive component of the composition than is the filler material.

Preferred fillers include slate dust which imparts a black color, green shale, red clay and white clay. These fillers can be combined to provide commonly used wood shake shingle colors such as light brown, gray and dark brown. By selecting the appropriate color for the filler material, the desired color of the molded shingle can be produced without the use of pigments. This is an important feature of the molded shingle because experience has shown that molded roof tiles and shingles using pigments tend to bleach out or wear off and change color after the shingle has been subjected to weathering on a roof. It is preferred that any slate present have a fineness such that substantially all the material is capable of passing through an 18 mesh screen, and that any shale present also have a fineness such that substantially all the material is capable of passing through an 18 mesh screen.

Preferably, the composition includes no more than about five percent, and more preferably about two to three percent by weight, chopped glass fibers, such as one-quarter inch 405 glass fibers from Owens-Coring Fiberglas Corporation, Toledo, Ohio. A smaller percentage of other reinforcement fibers, such as nylon fibers, may also be used. One of the surprising aspects of the shingle of the invention is that the flexural strength is at a level sufficient for the product requirements with only a small percentage of reinforcement fibers in the composition. One would expect a higher percentage of reinforcement fiber would be needed for such flexural strength. A test for flexural strength is an International Congress of Building Officials (ICBO) test which measures the load carrying capacity of a material, and simulates the loading of roofing materials installed over spaced sheathing.

The molding process includes mixing the resin and the filler by any suitable means, such as a bulk molding compound mixer. A charge of the composition can be applied to a compression mold operating at a temperature within the range of from about 300° F. to about 350° F., and within a pressure range of from about 600 psi to about 800 psi. If glass fibers are used, they should be added after nearly all the mixing is completed. Other molding processes, such as injection molding or transfer molding, can be used with the invention.

A very important attribute of the shingles of the invention is that when applied to a roof they will form a class A fire barrier. The class A fire barrier is determined by testing the roof according to ASTM test E108-93 for flame spread, burning brand and intermittent flame. The shingles of this invention can successfully pass the fire test without additional fireproofing measures such additional layers of underlayment of type 30 roofing felt or mineral surface cap sheets. The Class A fire rating can be achieved with the shingles of the invention, applied over either a solid wood deck or spaced sheathing, with an interleaved layer, such as 18-inch type 30 felts, applied on 10-inch centers or less, as is traditional in the application of wood shake shingles.

It will be evident from the foregoing that various modifications can be made to this invention. Such, however, are considered as being within the scope of the invention.

INDUSTRIAL APPLICABILITY

The invention can be useful for aesthetically pleasing roofing shingles having high weatherability and a Class A fire rating.

We claim:

1. A roofing shingle made from a composition comprising an organic, resinous material and an inorganic filler material, the roofing shingle having a structure comprising: (a) a top surface forming an upper, headlap portion and a lower, tab portion; (b) means defining a cavity under said top surface, said means defining a cavity comprising a first side surface extending downward from said top surface and having a bottom edge, a second side surface extending downward from said top surface and having a bottom edge, an upper end surface extending downward from said top surface and having a bottom edge, and a butt end surface extending downward from said top surface and having a bottom edge, said bottom edges of the first side surface, the second side surface, the upper end surface and the butt end surface generally lying in a common plane, wherein the structure has a generally rectangular perimeter defined by said first side surface, said second side surface, said upper end surface and said butt end surface, with the headlap portion having an upper end defined by the upper end surface and the tab portion having a lower end defined by the butt end surface; (c) a plurality of ribs within said cavity and extending downward from said top surface, said plurality of ribs including supporting ribs extending from said top surface to said common plane and recessed ribs under said tab portion extending from said top surface to a point above said common plane; (d) at least one strip in the headlap portion for receiving fasteners; (e) a grooved break line between and parallel to said first and second side surfaces extending from said upper end to a midpoint between the upper end and the lower end; and (f) a cutout portion between and parallel to said first and second side surfaces extending from said midpoint to said lower end.

2. A roofing shingle according to claim 1, wherein the grooved break line and the cutout portion are at a distance of about 5.5 inches from the first side surface and a distance of about 7.5 inches from the second side surface.

3. A roofing shingle according to claim 1, wherein the grooved break line defines an attachment strip of a strength that enables the structure to be fastened to a roof deck without separating along the break line and the structure to be alternatively separated by hand into two smaller shingles.

4. A roofing shingle according to claim 1, wherein said at least one strip comprises a nailing strip adjacent the upper end having spaced-apart ridges parallel to said first and second side surfaces for aligning with the recessed ribs of an overlying shingle.

5. A roofing shingle made from a composition comprising an organic, resinous material and an inorganic filler material, the roofing shingle having a structure comprising: (a) a top surface forming an upper, headlap portion and a lower, tab portion; (b) means defining a cavity under said top surface, said means defining a cavity comprising a first side surface extending downward from said top surface, a second side surface extending downward from said top surface, an upper end surface extending downward from said top surface, and a butt end surface extending downward from said top surface; (c) recessed ribs within said cavity under said tab portion extending downward from said top surface; and (d)

at least one strip in the headlap portion adjacent the upper end having spaced-apart ridges parallel to said two side surfaces for aligning with the recessed ribs of an overlying shingle, and means for receiving fasteners between adjacent ridges.

6. A roofing shingle according to claim 5, wherein the structure is integrally molded and has a rectangular perimeter defined by said first side surface, said second side surface, said upper end surface and said butt end surface, with the headlap portion having an upper end defined by the upper end surface and the tab portion having a lower end defined by the butt end surface.

7. A roofing shingle according to claim 6, wherein the structure further comprises a grooved break line between and parallel to said first and second side surfaces extending from said upper end to a midpoint between the upper end and the lower end, and a cutout portion between and parallel to said first and second side surfaces extending from said midpoint to said lower end.

8. A roofing shingle according to claim 7, wherein the grooved break line and the cutout portion are at a distance of about 5.5 inches from the first side surface and a distance of about 7.5 inches from the second side surface.

9. A roofing shingle according to claim 6, wherein the tab portion is divided into a lower tab part extending from the lower end and an upper tab part extending from the lower tab part to the headlap portion, and the headlap portion has an upper headlap part extending from the upper end and a lower headlap part extending from the upper headlap part to the tab portion, where the upper tab part and the lower headlap part have an equal and constant thickness, the lower tab part has a thickness greater than the thickness of the upper tab part and lower headlap part, and the upper headlap part has a thickness less than the thickness of the upper tab part and lower headlap part.

10. A roofing shingle according to claim 9, wherein the thickness of the lower tab part increases toward the lower end and the thickness of the upper headlap part decreases toward the upper end.

11. A roofing shingle according to claim 10, wherein the top surface contains grooved markings giving the shingle an appearance like a wooden shake shingle, and oblique surfaces in said butt end.

12. A roofing shingle according to claim 9, wherein:

said composition is fire resistant;

said resinous material is present in the composition in an amount of from about 12 to about 35 percent by weight, the resinous material comprising polyester resin derived from input stock containing polyethylene terephthalate; and said inorganic filler material is present in the composition in an amount of from about 65 to about 88 percent by weight, the filler material consisting essentially of one or more ingredients selected from the group consisting of clay particles, slate particles, shale particles and glass fibers, the filler material imparting a color to the shingle.

13. A roofing shingle according to claim 5, wherein said filler material comprises at least one ingredient selected from slate dust, green shale, red clay and white clay.

14. A roofing shingle made from a composition comprising an organic, resinous material and an inorganic filler material, the roofing shingle having a structure comprising: (a) a top surface forming an upper, headlap portion and a lower, tab portion; (b) means defining a cavity under said top surface, said means defining a cavity comprising a first side surface, a second side surface, an upper end surface and a butt end surface all extending downward from said top surface, with the headlap portion having an upper end defined by the upper end surface and the tab portion having a lower end defined by the butt end surface; (c) a plurality of ribs within said cavity extending downward from said top surface; and (d) a grooved break line between and parallel to said first and second side surfaces extending from said upper end to a midpoint between the upper end and the lower end, and a cutout portion between and parallel to said first and second side surfaces extending from said midpoint to said lower end.

15. A roofing shingle according to claim 14, wherein the grooved break line and the cutout portion are at a distance of about 5.5 inches from the first side surface and a distance of about 7.5 inches from the second side surface.

16. A roofing shingle according to claim 14, wherein the structure has a generally rectangular perimeter defined by said first side surface, said second side surface, said upper end surface and said butt end surface.

17. A roofing shingle according to claim 16, wherein the tab portion is divided into a lower tab part extending from the lower end and an upper tab part extending from the lower tab part to the headlap portion, and the headlap portion has an upper headlap part extending from the upper end and a lower headlap part extending from the upper headlap part to the tab portion, where the upper tab part and the lower headlap part have an equal and constant thickness, the lower tab part has a thickness greater than the thickness of the upper tab part and lower headlap part, and the upper headlap part has a thickness less than the thickness of the upper tab part and lower headlap part.

18. A roofing shingle according to claim 17, wherein the thickness of the lower tab part increases toward the lower end and the thickness of the upper headlap part decreases toward the upper end.

19. A roofing shingle according to claim 14, wherein the tab portion of the top surface contains grooved markings giving the shingle an appearance like a wooden shake shingle.

20. A roofing shingle according to claim 19, wherein:

said composition is fire resistant and has a color imparted by the filler material;

said resinous material is present in the composition in an amount of from about 12 to about 35 percent by weight, the resinous material comprising polyester resin derived from input stock containing polyethylene terephthalate; and said inorganic filler material is present in the composition in an amount of from about 65 to about 88 percent by weight, the filler material consisting essentially of one or more ingredients selected from the group consisting of clay particles, slate particles, shale particles and glass fibers.

21. A roofing shingle according to claim 14, wherein said filler material comprises at least one ingredient selected from slate dust, green shale, red clay and white clay.

22. A roofing shingle according to claim 21, wherein the structure is integrally molded and further comprises a first nailing strip in the headlap portion adjacent the upper end and a second nailing strip in the headlap portion adjacent the tab portion, said first and second side surfaces having opposing curved portions across from said midpoint.

23. A roofing shingle according to claim 14, wherein the structure has a generally rectangular perimeter defined by said first side surface, said second side surface, said upper end surface and said butt end surface, and said plurality of ribs includes side ribs generally perpendicular to said first and second side surfaces.

24. A roofing shingle made from a composition comprising an organic, resinous material and an inorganic filler material, the shingle having a structure comprising: (a) a top surface forming an upper, headlap portion and a lower, tab portion; (b) means defining a cavity under said top surface, said means defining a cavity comprising a first side surface, a second side surface, an upper end surface and a butt end surface all extending downward from said top surface to a common plane; and (c) a plurality of ribs within said cavity extending downward from said top surface to the common plane or a point above the common plane; wherein the tab portion is divided into a lower tab part extending from a lower end defined by the butt end surface and an upper tab part extending from the lower tab part to the headlap portion, and the headlap portion has an upper headlap part extending from an upper end defined by the upper end surface and a lower headlap part extending from the upper headlap part to the tab portion, where the upper tab part and the lower headlap part have an equal and constant thickness, the lower tab part has a thickness greater than the thickness of the upper tab part and lower headlap part, and the upper headlap part has a thickness less than the thickness of the upper tab part and lower headlap part.

25. A roofing shingle according to claim 24, wherein the thickness of the lower tab part increases toward the lower end and the thickness of the upper headlap part decreases toward the upper end.

26. A roofing shingle according to claim 24, wherein the tab portion of the top surface contains grooved markings giving the shingle an appearance like a wooden shake shingle.

27. A roofing shingle according to claim 24, wherein:

said filler material comprises at least one ingredient selected from slate dust, green shale, red clay and white clay; and said structure is integrally molded and has a generally rectangular perimeter defined by said first side surface, said second side surface, said upper end surface and said butt end surface.

28. A roofing shingle according to claim 24, wherein the structure is integrally molded and further comprises a grooved break line defining a thin attachment strip between and parallel to said first and second side surfaces extending from said upper end to a midpoint between the upper end and the lower end, and a cutout portion between and parallel to said first and second side surfaces extending from said midpoint to said lower end.

29. A roofing shingle according to claim 28, wherein the attachment strip and the cutout portion are at a distance from said first side surface that is less than the distance from said second side surface, and the attachment strip has a thickness narrowing toward one of the first and second side surfaces.

30. A roofing shingle according to claim 24, wherein the structure is integrally molded and has a generally rectangular perimeter defined by said first side surface, said second side surface, said upper end surface and said butt end surface, and said plurality of ribs includes side ribs generally perpendicular to said first and second side surfaces and recessed ribs generally parallel to said first and second side surfaces.

31. A roofing shingle according to claim 24, wherein said butt end has a plurality of oblique surfaces at differing angles.

32. A roofing shingle made from a composition comprising an organic, resinous material and an inorganic filler material, the roofing shingle having a structure comprising: (a) a top surface forming an upper, headlap portion and a lower, tab portion; (b) means defining a cavity under said top surface, said means defining a cavity comprising a first side surface extending downward from said top surface and having a bottom edge, a second side surface extending downward from said top surface and having a bottom edge, an upper end surface extending downward from said top surface and having a bottom edge, and a butt end surface extending downward from said top surface and having a bottom edge, said bottom edges of the first side surface, the second side surface, the upper end surface and the butt end surface generally lying in a common plane, wherein the structure has a generally rectangular perimeter defined by said first side surface, said second side surface, said upper end surface and said butt end surface, with the headlap portion having an upper end defined by the upper end surface and the tab portion having a lower end defined by the butt end surface; (c) a plurality of ribs within said cavity and extending downward from said top surface, said plurality of ribs including supporting ribs extending from said top surface to said common plane and recessed ribs under said tab portion extending from said top surface to a point above said common plane; and (d) at least one strip in the headlap portion for receiving fasteners comprising a nailing strip adjacent the upper end having spaced-apart ridges parallel to said first and second side surfaces for aligning with the recessed ribs of an overlying shingle.

33. A roofing shingle according to claim 32, wherein the tab portion is divided into a lower tab part extending from the lower end and an upper tab part extending from the lower tab part to the headlap portion, and the headlap portion has an upper headlap part extending from the upper end and a lower headlap part extending from the upper headlap part to the tab portion, where the upper tab part and the lower headlap part have an equal and constant thickness, the lower tab part has a thickness greater than the thickness of the upper tab part and lower headlap part, and the upper headlap part has a thickness less than the thickness of the upper tab part and lower headlap part.

34. A roofing shingle according to claim 33, wherein the thickness of the lower tab part increases toward the lower end and the thickness of the upper headlap part decreases toward the upper end.

35. A roofing shingle according to claim 32, wherein the tab portion of the top surface contains grooved markings giving the shingle an appearance like a wooden shake shingle.

36. A roofing shingle according to claim 32, wherein:

said composition is fire resistant such that a plurality of shingles applied to a roofing deck forms a fire barrier;

said resinous material is present in the composition in an amount of from about 12 to about 35 percent by weight, the resinous material comprising polyester resin derived from input stock containing polyethylene terephthalate; and said inorganic filler material is present in the composition in an amount of from about 65 to about 88 percent by weight, the filler material consisting essentially of one or more ingredients selected from the group consisting of clay particles, slate particles, shale particles and glass fibers, the filler material imparting a color to the shingle.

37. A roofing shingle according to claim 32, wherein said filler material comprises at least one ingredient selected from slate dust, green shale, red clay and white clay.

38. A roofing shingle according to claim 32, wherein the composition comprises reinforcement fibers.

39. A roofing shingle made from a composition comprising an organic, resinous material and an inorganic filler material, the roofing shingle having a structure comprising: (a) a top surface forming an upper, headlap portion and a lower, tab portion; (b) means defining a cavity under said top surface, said means defining a cavity comprising a first side surface extending downward from said top surface and having a bottom edge, a second side surface extending downward from said top surface and having a bottom edge, an upper end surface extending downward from said top surface and having a bottom edge, and a butt end surface extending downward from said top surface and having a bottom edge, said bottom edges of the first side surface, the second side surface, the upper end surface and the butt end surface generally lying in a common plane, wherein the structure has a generally rectangular perimeter defined by said first side surface, said second side surface, said upper end surface and said butt end surface, with the headlap portion having an upper end defined by the upper end surface and the tab portion having a lower end defined by the butt end surface, and wherein the tab portion is divided into a lower tab part extending from the lower end and an upper tab part extending from the lower tab part to the headlap portion, and the headlap portion has an upper headlap part extending from the upper end and a lower headlap part extending from the upper headlap part to the tab portion, where the upper tab part and the lower headlap part have an equal and constant thickness, the lower tab part has a thickness greater than the thickness of the upper tab part and lower headlap part, and the upper headlap part has a thickness less than the thickness of the upper tab part and lower headlap part; (c) a plurality of ribs within said cavity and extending downward from said top surface, said plurality of ribs including supporting ribs extending from said top surface to said common plane and recessed ribs under said tab portion extending from said top surface to a point above said common plane; and (d) at least one strip in the headlap portion for receiving fasteners.

* * * * *